US007527173B2

(12) United States Patent
Lasserre et al.

(10) Patent No.: US 7,527,173 B2
(45) Date of Patent: May 5, 2009

(54) DISPENSING DEVICE FOR A COSMETIC PRODUCT

(75) Inventors: Pierre-Andre Lasserre, Coubron (FR); Marcel Sanchez, Paris (FR)

(73) Assignee: L'Oreal, Paris (FR)

( * ) Notice: Subject to any disclaimer, the term of this patent is extended or adjusted under 35 U.S.C. 154(b) by 330 days.

(21) Appl. No.: 11/251,891

(22) Filed: Oct. 18, 2005

(65) Prior Publication Data

US 2006/0081661 A1 Apr. 20, 2006

Related U.S. Application Data

(60) Provisional application No. 60/622,604, filed on Oct. 28, 2004.

(30) Foreign Application Priority Data

Oct. 18, 2004 (FR) ..... 04 52357

(51) Int. Cl.
*B67B 5/00* (2006.01)
*B67D 5/00* (2006.01)

(52) U.S. Cl. ..... 222/153.11; 222/153.13; 222/402.11; 222/321.8

(58) Field of Classification Search ..... 222/153.13, 222/153.14, 153.11, 402.11, 546, 402.1, 222/550, 402.12, 402.13, 402.23, 562, 321.7, 222/321.8, 321.9; 239/333
See application file for complete search history.

(56) References Cited

U.S. PATENT DOCUMENTS 3,169,673 A 2/1965 Focht
3,254,677 A 6/1966 Wakeman
3,401,843 A * 9/1968 Ahrens et al. ..... 222/182
3,510,029 A 5/1970 Doyle
3,749,286 A * 7/1973 Douglas ..... 222/153.11
3,904,088 A 9/1975 Milbourne
D316,675 S * 5/1991 Cramer ..... D9/448
5,085,353 A 2/1992 Inui et al.

(Continued)

FOREIGN PATENT DOCUMENTS

DE 2655777 6/1978

(Continued)

*Primary Examiner*—Frederick C Nicolas
*Assistant Examiner*—Stephanie E Tyler
(74) *Attorney, Agent, or Firm*—Oblon, Spivak, McClelland, Maier & Neustadt, P.C.

(57) ABSTRACT

A dispensing device which can be mounted on a container fitted with a dispensing element through which a product held in the container can emerge when this element is actuated. The device includes an element for mounting the device on the container, and a dispensing head. The dispensing head includes a dispensing orifice and a conduit to channel the product emerging from the dispensing element to the dispensing orifice. An actuating surface is movable relative to the mounting element, and actuates the dispensing element. In a preferred example, the actuating surface and the conduit are formed by molding as a single piece. A closure member is configured to cover the dispensing orifice in a stowed position. Movement of the closure element to the stowed position involves a force exerted by the closure element on the head, axially to the conduit, in the direction toward the dispensing element. In addition, a stop is designed to limit the movement of the dispensing head in the direction toward the dispensing element as the closure element moves to the stowed position.

38 Claims, 4 Drawing Sheets

U.S. PATENT DOCUMENTS

| | | | | |
|---|---|---|---|---|
| 5,158,233 | A * | 10/1992 | Foster et al. | 239/333 |
| 6,247,613 | B1 * | 6/2001 | Meshberg | 222/1 |
| 2004/0222245 | A1 * | 11/2004 | Marroncles | 222/402.13 |
| 2004/0245294 | A1 * | 12/2004 | Mineau et al. | 222/402.13 |

FOREIGN PATENT DOCUMENTS

| | | | |
|---|---|---|---|
| EP | 1206972 | A1 | 5/2002 |
| EP | 0670275 | A1 | 9/2005 |
| FR | 1573165 | | 7/1969 |
| WO | WO 9631412 | | 10/1996 |

* cited by examiner

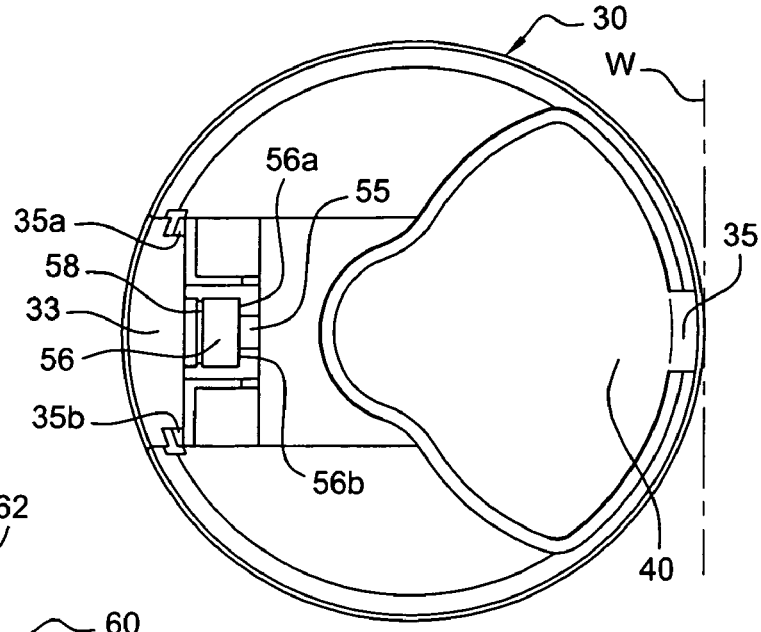
Fig. 3
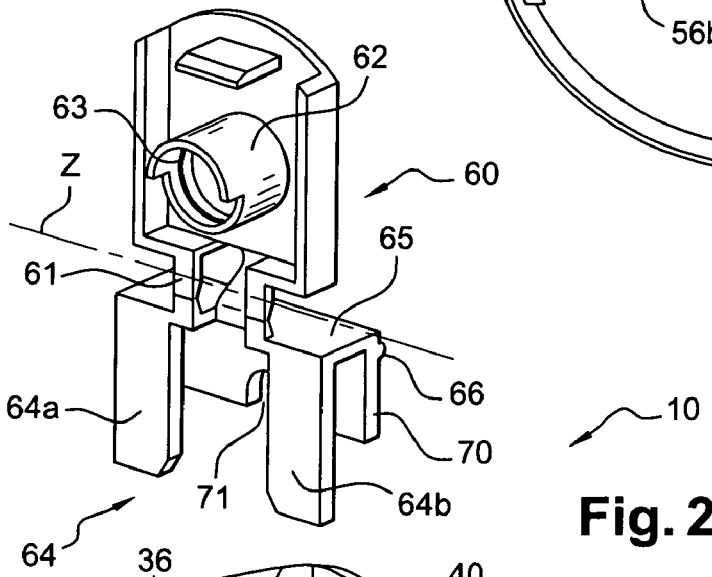
Fig. 2
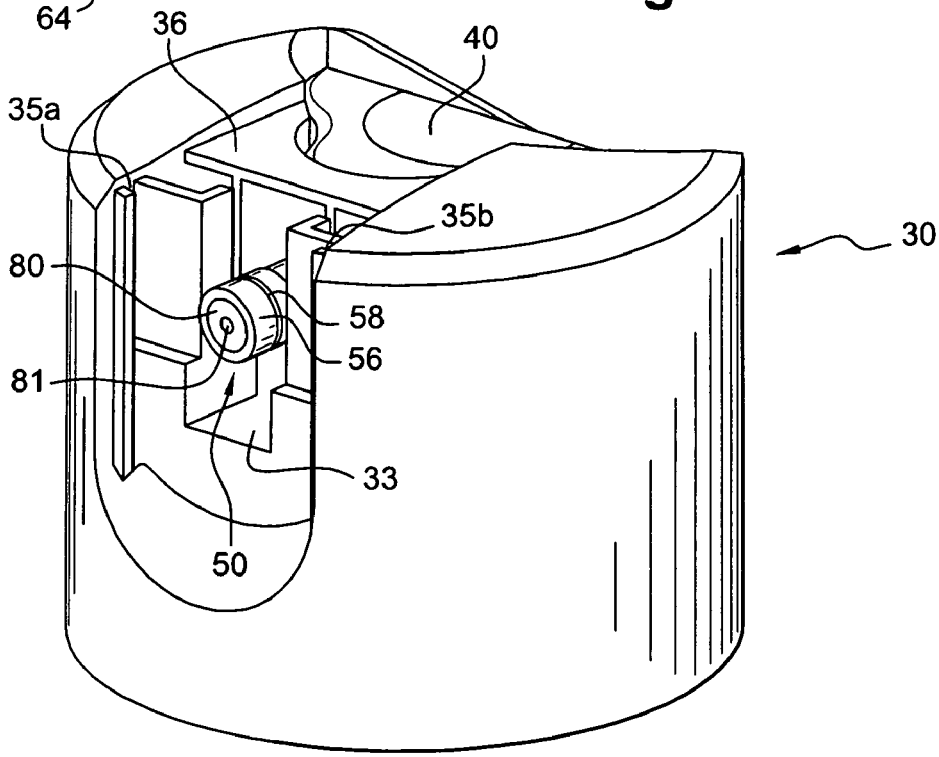

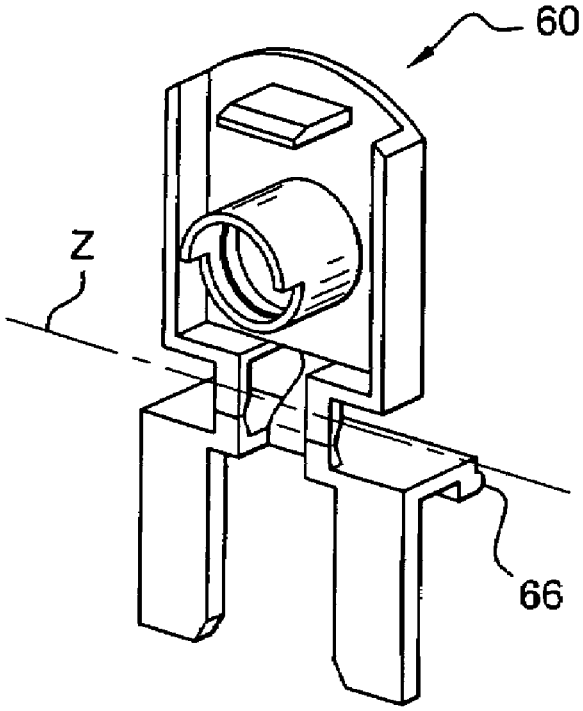
Fig. 6
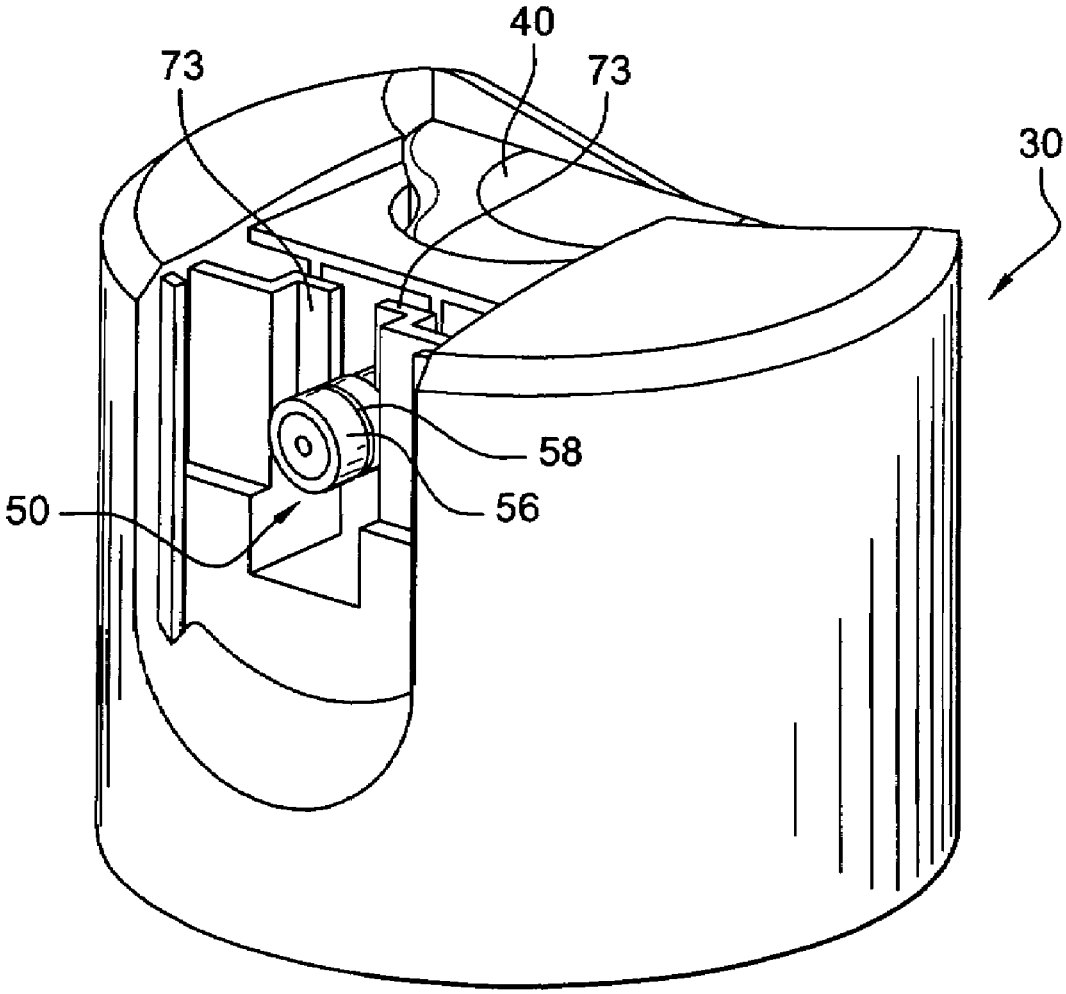

DISPENSING DEVICE FOR A COSMETIC PRODUCT

CROSS-REFERENCE TO RELATED APPLICATIONS

This document claims priority to French Application No. 04 52357, filed Oct. 18, 2004, and U.S. Provisional Application No. 60/622,604, filed Oct. 28, 2004, the entire contents of which are hereby incorporated by reference.

FIELD OF THE INVENTION

The present invention relates a dispensing device for a product, and in particular to a device for spraying liquids in the form of a cloud of fine droplets, of the aerosol or spray type, etc.

BACKGROUND OF THE INVENTION

Discussion of Background

According to a preferred form, the invention provides a device which is particularly advantageous for sprayable cosmetic products containing a certain quantity of resin designed to solidify on contact with the air. Non-limiting applications include, by way of example, hairstyling products such as hair lacquers and hair sprays. The invention can be used in other fields, for example, applications in the pharmaceutical field or for products such as paints, adhesives, etc.

In the field of cosmetics in particular (hair lacquers for example), many spray type products contain soluble polymers which, by evaporation of the solvent contained therein, are capable of solidifying.

Typically, such products are placed under pressure, either mechanically by means of a pump, or by means of a propellant gas, and the release of product is controlled by a dispensing head in the form of a pushbutton. It has been found that, after each spraying action obtained by pressing the pushbutton, an "inrush of air" tends to occur when the pressure exerted on the push button is relaxed. This air enters the delivery channel via the spray orifice, causing the resin in the residual product present in different parts of the dispensing head to solidify. The problem rapidly becomes critical in constricted spaces, particularly inside the delivery channel, and more particularly in proximity to the spray orifice. Thus, after a long period between uses, the resin will solidify at these points thereby blocking the dispensing head.

A solution to this problem involves immersing the pushbutton in a quantity of hot water, thereby causing the resins deposited inside the dispensing head to liquefy and facilitating the removal of these deposits. Although effective on certain deposits, this solution is obviously not very satisfactory.

EP-A-670 275 describes a device for dispensing the contents of a pressurised container, including a closure cap for the product dispensing aperture mounted slidably in a bore designed to communicate with the inside of the container. After each use, the closure cap seals off the dispensing aperture, thereby preventing any backflow of air into the delivery channels of the dispensing head.

In U.S. Pat. No. 3,254,677, the pushbutton is fitted with a kind of sliding yoke which, in the rest position, closes off the discharge aperture, and which is automatically released when the pushbutton is actuated.

In patent FR 1 573 165, a closure tab, integral with a resilient diaphragm, is pushed backward under the pressure of the product, thereby exposing the dispensing aperture. When product dispensing ceases, the closure seals off the dispensing aperture. Another retraction-type closure system is also described in U.S. Pat. No. 5,085,353.

All of these mechanisms have the drawback of being relatively complicated, and of substantially increasing the production cost of the dispensers. Moreover, some of these devices are fragile and can be unreliable in operation.

Spray devices that are simpler to make have been described in DE 2655777, U.S. Pat. No. 3,904,088 and U.S. Pat. No. 3,510,029. These spray devices include a dispensing head mounted on a valve stem and a cap fitted with a closure flap designed to conceal the spray orifice in the stowed position and to expose it in the use position.

In DE 26 55777 and U.S. Pat. No. 3,904,088, the flap only moves in front of the aperture in order to close it off and remains at a slight distance from the aperture. In U.S. Pat. No. 3,510,029, the internal face of the flap engages in a leaktight manner with an opening into which the spray orifice emerges. In the configuration described, the product is dispensed via a simple orifice as no fitted nozzle is provided in the opening. The orifice is additionally located in proximity to the axis of the valve stem, and the orifice relatively distant from the envelope surface of the container. In addition, the dispensing head is a component separate from the pushbutton so that an assembly stage is required to put the two components together.

SUMMARY OF THE INVENTION

One of the objects of the present invention is to provide a dispensing device which avoids or reduces one or more of the drawbacks mentioned in reference to devices of the prior art.

Another object of the present invention is to provide a dispensing device which prevents the product from drying inside conduits of the device between uses.

It is a further object of the invention to provide a dispensing device that has a relatively simple structure.

Other objects of the present invention will become evident from the detailed description which follows.

According a preferred example of the invention, a dispensing device is provided which can be mounted on a container fitted with a dispensing element through which product held in the container can emerge when the element is actuated. The device includes an element for mounting the device on the container. A dispensing head includes a dispensing orifice and a conduit to channel the product emerging from the dispensing element to the dispensing orifice. In addition, an actuating surface is provided, which is movable relative to the mounting piece, to actuate the dispensing element. For example, the actuating surface and the conduit can be formed by molding in a single piece. A closure member is configured to cover the dispensing orifice in a stowed position, and movement of the closure element to the stowed position is achieved from a force exerted by the closure element on the head, axially to the conduit, in the direction toward the dispensing element. Further, a stop is designed to limit the movement of the dispensing head in this direction as the closure element moves to the stowed position.

As the closure element bears against the head, it thus can be positioned as close as possible to the dispensing orifice thereby minimizing the presence of air in proximity to the orifice which is liable to cause the product to dry in the conduit of the dispensing head.

In addition, the presence of the stop serves to limit the retraction movement of the head when the closure element moves to the stowed position. This prevents the dispensing element on which the head is mounted from being actuated by the movement of the head.

The stop can be arranged in a manner such that a portion of the head is designed to bear against the stop when the closure element moves to the stowed position. The stop can thus be placed relatively close to the end of the head against which the closure element bears, thereby effectively preventing the retraction movement of the head.

The stop can be placed in proximity to the end of the head delineating the dispensing orifice. For example, the stop can be placed between the dispensing orifice and the portion of the head located on the axis of the dispensing element, and preferably closer to the dispensing orifice than to the portion of the head located on the axis of the dispensing element.

Preferably, by way of example, the stop can be arranged in a manner such that it is immobile during the movement of the actuating surface.

By way of example, the stop can include a notch configured to straddle the dispensing conduit. Alternatively, also by way of example, the stop can include two vertical walls integral with the mounting piece, with each vertical wall being situated on either side of the conduit.

The closure element can be, for example, a flap pivoted, such as by a film hinge, on the mounting piece about an axis, such as an axis substantially perpendicular to the principal axis of the conduit. The closure element can thus be made by molding in a single piece.

The closure element can be configured so that, in the stowed position, it limits the movement of the actuating surface, thereby preventing actuation of the dispensing element. The flap can include a wall, for example, intended to be placed against the dispensing orifice, with the wall being provided with a projecting element designed to fit, at least particularly, under the end of the conduit of the dispensing head. For example, the end of the head can be cylindrical and the projecting element can be a cylindrical skirt designed to surround the end of the conduit of the dispensing head. In addition, the closure element can be configured to close off the dispensing orifice in a leaktight manner so as to minimize drying of the product inside the head conduit. The outer surface of the conduit end may, for example, include an annular groove suitable for receiving an annular bead provided on the inner surface of the cylindrical skirt.

According to a disclosed example, the mounting piece can include a frontal opening facing the dispensing orifice, and this frontal opening can be sufficiently large so that the dispensing orifice remains facing the opening when the actuating surface is operated.

The closure element can include a mounting bracket for attachment to the mounting piece, and the bracket can include two vertical ribs designed to run in two slides provided on the mounting piece, for example. The slides can be located on each side of the frontal opening.

By way of example, the mounting piece, the actuating surface and the head can be obtained by molding as a single piece. The stop can also be obtained by molding in one piece with the mounting piece, the actuating surface and the head. Further by way of example, the closure element can also be obtained by molding in one piece with the mounting piece, the actuating surface and the head. The dispensing device can thus be produced at low cost.

The dispensing orifice can be delineated by a fitted nozzle, for example, such as a swirl nozzle. The nozzle can be fitted at one end of the conduit of circular transverse cross-section.

The invention also provides a packaging and dispensing device including a container holding the product to be dispensed, with the container equipped with a dispensing device such as that just described. The container can be pressurized and surmounted by a valve stem. The product held in the container can be a cosmetic product, for example, a hair product such as a lacquer.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

Apart from the arrangements described above, the invention can include a number of other features which will be explained below, in relation to non-limiting embodiments, described with reference to the attached figures in which:

FIG. 2 illustrates an exploded view of the dispensing device of the device illustrated in FIG. 1;

FIG. 3 illustrates a top view of the device in FIG. 2 without the closure flap;

FIG. 6 illustrates an alternative embodiment of the dispensing device according to the invention.

DETAILED DESCRIPTION OF PREFERRED EMBODIMENTS

Figure 1:
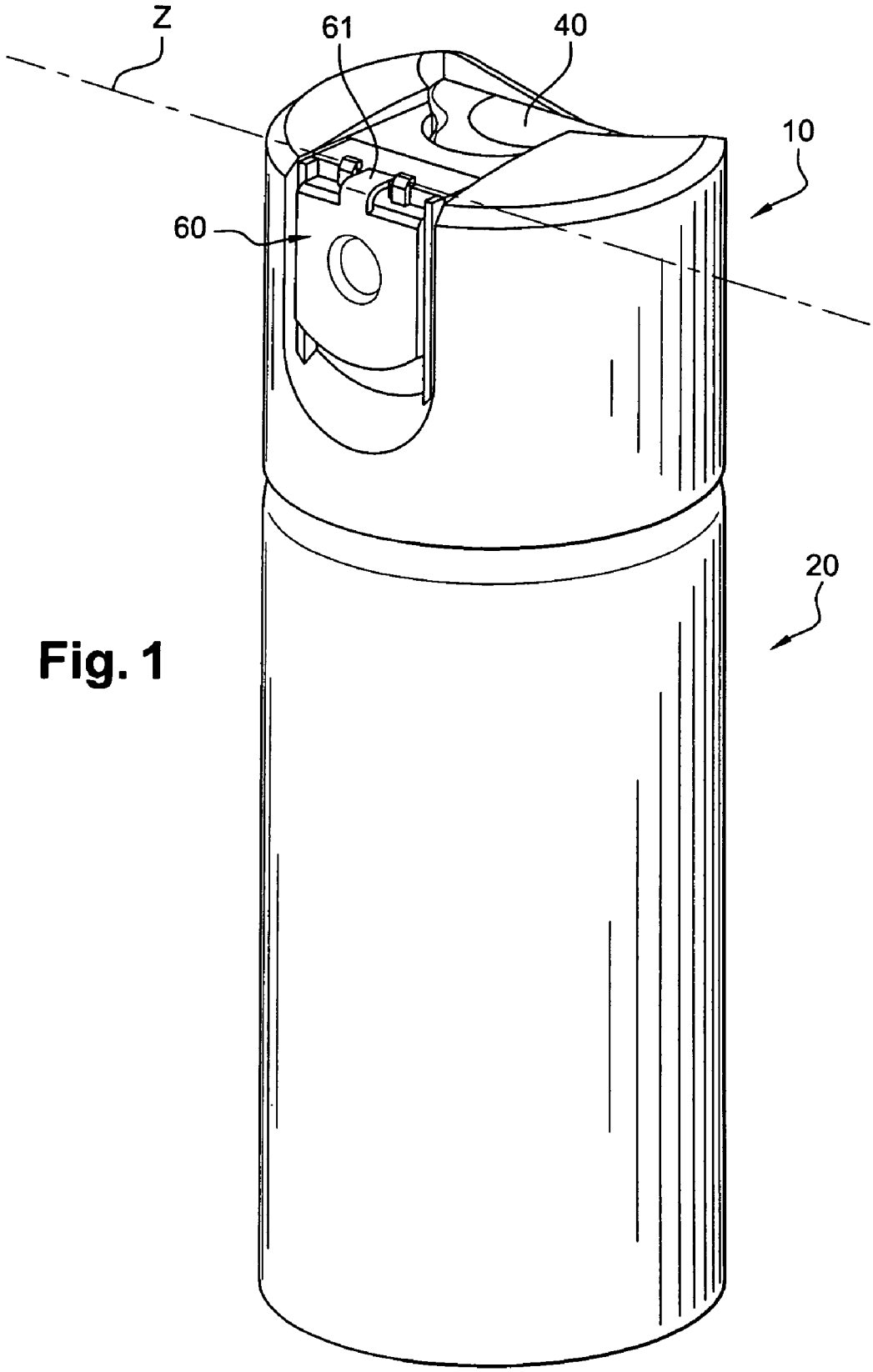
FIG. 1 illustrates a perspective view of a packaging and dispensing device according to the invention.
Figure 4:
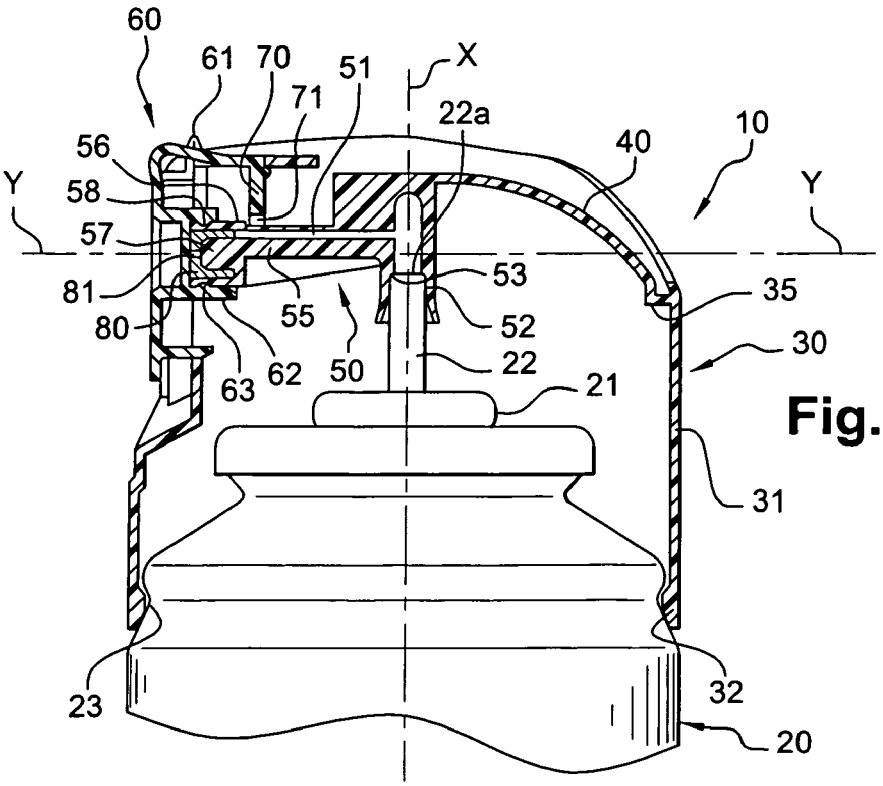
FIG. 4 shows a partial sectional view of the device illustrated in FIG. 1.

FIG. 1 shows an example of a dispensing device 10 mounted on a container 20. The container 20 includes, for example, a pressurized can fitted with a valve mounted by crimping in a cup 21 closing the upper part of the can, in the conventional manner. The valve in this example has a hollow valve stem 22 with a lengthwise axis X (FIG. 4). The valve can be of any known type, and may be actuated for example by pushing down on the stem.

The container may contain a product to be sprayed, for example a cosmetic product, and a propellant gas, which may or may not be stored in liquefied form in the container and which may or may not be dispensed with the product.

In the illustrated example, the dispensing device 10 includes a mounting piece 30, an actuating surface 40 and a dispensing head 50.

Figure 5:
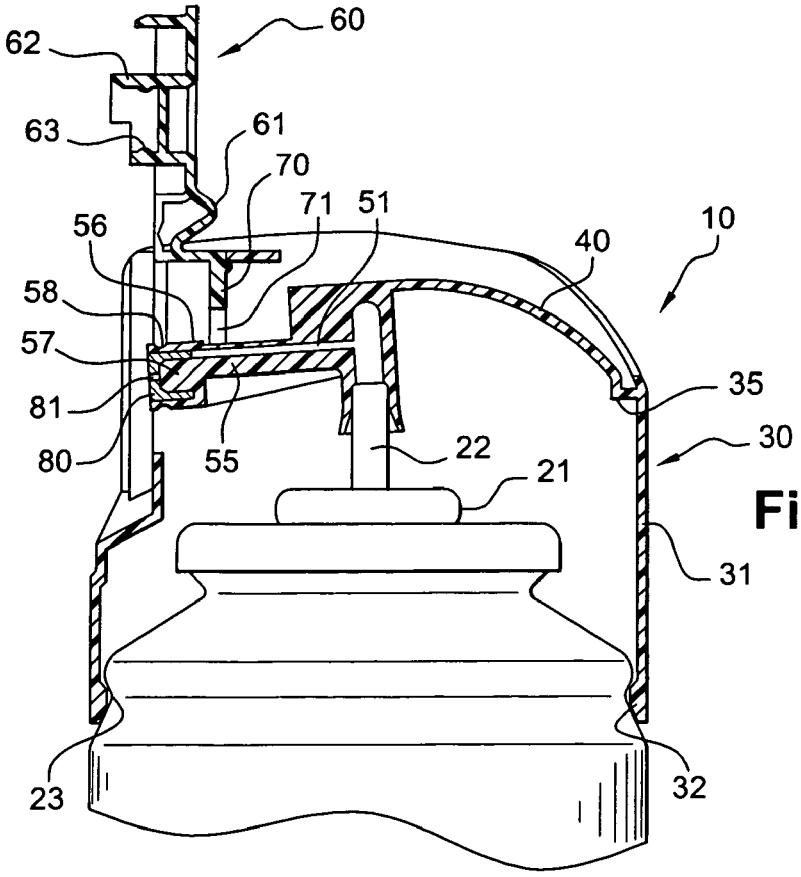
FIG. 5 shows a partial sectional view of the device during use.

The mounting piece 30 includes a mounting skirt 31 which has a bead 32 (FIG. 4) at its lower end enabling it to snap into an annular groove 23 present on the upper part of the can. The mounting skirt 31 is traversed by a frontal opening 33 (see, e.g., FIGS. 2 and 3) through which the product can be dispensed when pressure is applied to the actuating surface 40, as illustrated in FIG. 5.

The mounting skirt 31 is connected at the upper part to the actuating surface 40 by a film hinge 35, enabling the actuating surface to pivot relative to the mounting piece about an axis W (FIG. 3). The actuating surface 40 is intended to provide a bearing surface for the user's finger.

The actuating surface 40 is connected, inside the device, to the dispensing head 50 which delineates a channel 51 designed to convey the product from the valve stem 22 to a dispensing orifice 81.

In this example, the head 50 includes a cylindrical rotating skirt 52 extending substantially in the axis X of the valve stem. The cylindrical skirt 52 is connected at its upper part to the actuating surface. At its lower end, the cylindrical skirt 52 defines a shouldered recess 53 into which the upper part of the valve stem can engage in a substantially leaktight manner, as can be seen in FIGS. 4 and 5. It can also be seen in these Figures that the valve stem 22 abuts at its upper end 22*a* against the shoulder 53 of the recess. The skirt 52 delineates a first portion of the product delivery channel 51.

The delivery channel 51 extends into a second portion, oriented transversely to the first, which is delineated by a conduit 55. In the illustrated example, the conduit 55 is elongated and extends in a direction along an axis Y, perpendicular to the axis X of the valve stem, and extends from the cylindrical skirt 52 to an end 56 emerging via a dispensing orifice 81. By way of example, the end 56 of the conduit 55 includes a nozzle mount 57 to which the conduit 55 is connected and to which a conventional swirl nozzle 80 can be attached, as can be seen in the Figures, with the nozzle delineating the dispensing orifice 81. The nozzle mount 57 incorporates a pin, also referred to as a "centerpost", for this purpose. The presence of the nozzle enables the product to be atomised in the form of a good quality spray.

As can be seen in particular in FIG. 3, the transverse cross-section of the end 56 of the conduit 55 is larger and extends beyond the transverse cross-section of the rest of the conduit, on each side of the conduit, thereby delineating two bearing surfaces 56*a* and 56*b*, located to either side of the conduit, the function of which will be explained in due course.

The conduit 55 extends on axis Y over a length greater than the length of the skirt 52 measured on axis X in this example. In particular, the length of the conduit 55 allows the dispensing orifice to be placed some distance from the valve stem thereby preventing the product emerging via the orifice from soiling the user's fingers when the actuating surface 40 is pressed. It is possible, for example, to use a conduit 55 of a length such that the orifice 81 extends substantially beyond the wall of the container.

In the example illustrated, the dispensing head 50 is made by plastic molding in one piece with the actuating surface 40 and the mounting piece 30.

A closure element 60 is provided to cover the dispensing orifice 81 in the stowed position as illustrated in FIG. 4. The closure element is in the form of a flap and includes a wall intended to be placed against the dispensing orifice. The flap 60 is pivoted on the mounting piece by means of a film hinge 61 about an axis Z. The film hinge 61 is a spring-effect hinge for example. Preferably, the axis Z is substantially perpendicular to the principal axis Y of the conduit.

The flap 60 is configured so as to immobilize the actuating surface 40 when it is closed. To this end, it includes a projecting member 62 on the surface of its wall designed to line up with the dispensing orifice 81. The projecting member 62 is designed to fit under the end 56 of the conduit 55 of the dispensing head to prevent it from pivoting forward. In particular, the projecting member 62 is a cylindrical skirt designed to surround the end 56 of the conduit 55 of the dispensing head. While the head 50 is prevented from moving, the actuating surface 40 which is integral with the head 50 is therefore unable to move.

The flap 60 is additionally configured to seal off the dispensing orifice 81. To this end, the cylindrical skirt 62 of the flap includes an annular bead 63 intended, when the flap 60 is in the closed position, to fit into an annular groove 58 provided at the end 56 of the conduit. The dispensing orifice 81 is thus perfectly isolated from the outside.

As can be seen in FIG. 2, the flap 60 is made from a component separate from the mounting piece 30. The flap 60 in this case includes a mounting bracket 64 for attachment to the mounting piece 30. The mounting bracket 64 includes for example two vertical ribs 64*a* and 64*b* designed to fit in two slides 35*a* and 35*b* provided on the mounting piece, with each slide being located on either side of the frontal opening 33 in the mounting piece. The two ribs 64*a* and 64*b* are connected, at their upper end, to a transverse wall 65 which includes a snap-on bead 66 on its rear face and is designed to cooperate with an upper wall 36 of the mounting piece under which it snaps into place.

When closed, the flap 60 bears against the dispensing head 50 on the principal axis Y of the conduit 55 of the dispensing head in the direction of the valve stem, and a stop 70 is provided to limit the movement of the dispensing head 50.

In the example illustrated in FIG. 1, the stop 70 is integral with the flap 60. The stop is obtained, for example, by molding in one piece with the flap 60. In the illustrated arrangement, by way of example, the stop 70 includes a wall connected to the mounting bracket 64 of the flap 60 by the transverse wall 65, with the stop 70 extending in a plane parallel to the axis X of the valve stem, and in particular parallel to the plane of ribs 64*a* and 64*b*. The stop 70 incorporates a notch 71 configured to straddle the conduit 55. Preferably, the stop is configured so as not to be in tight contact against the conduit 55 thereby facilitating the pivoting motion of the conduit 55 when the actuating surface 40 is operated. The stop 70 is additionally arranged to be positioned at the rear of the end portion 56 of the conduit 55, with the stop abutting on the two bearing surfaces 56*a* and 56*b* of the end 56 of the conduit 55 in the illustrated example.

According to a variant illustrated in FIG. 6, the stop 70 can be integral with the mounting piece 30 instead of being integral with the flap 60. The stop 70 can include for example two vertical walls 73 located to either side of the conduit 55. Here again, the two vertical walls are located at the rear of the end portion 56 of the conduit 55. In this variant, by way of example, the stop is formed by molding in one piece with the mounting element 30, the actuating surface 40 and the head 50. In another variant, not shown, provision can be made for the flap 60 to be obtained by one-piece molding with the other component parts of the dispensing device.

Preferably, the stop 70 is located in proximity to the end surface of the conduit 55 against which the flap 60 bears so as to maximize resistance to the bearing force of the flap on the conduit, thereby minimizing the movement of the conduit. It is possible in fact to use a stop of lower resistance than if it were positioned to the rear of the conduit to obtain the same resistance.

The stop 70 can preferably extend to a height, measured parallel to the axis X of the valve stem, sufficient for the bearing surfaces 56*a* and 56*b* at the end portion 56 of the conduit 55 to remain against the stop even when the actuating surface is operated.

As the stop 70 is attached to the mounting piece 30, it remains immobile when the actuating surface is operated.

To use the device, the user opens the flap 60 as shown in FIG. 5. The user can then press on the actuating surface 40 so that the head 50 depresses the valve stem 22. In the depressed position, the end 56 of the conduit 55 pivots substantially forward, in the direction of the container, by moving in the notch 71, as can be seen in FIG. 5.

After spraying the product, the user releases the actuating surface so that the conduit 55 reverts to its initial position. The user can then close off the dispensing orifice 81 by pivoting the flap 60 about the axis Z so as to place it against the orifice 81, then pressing on the flap in the direction of axis Y in order to snap the skirt 62 onto the end 56 of the conduit 55. During this movement, the conduit 55 is pushed or forced in a direction slightly backwards, on axis Y. However, the backward movement of the head is limited by the stop 70 against which the rear of the end 56 of the conduit is abutted.

In the foregoing detailed description reference is made to preferred embodiments of the invention. It is evident that variants thereto can be proposed without departing from the invention as claimed herebelow. It is therefore to be understood that, within the scope of the appended claims, the invention may be practiced otherwise than as specifically described herein.

What is claimed as new and desired to be secured by Letters Patent of the United States is:

1. A dispensing device which can be mounted on a container fitted with a dispensing element through which product held in the container can emerge when the dispensing element is actuated, the device including:

a mounting element for mounting the device on the container;

a dispensing head including a dispensing orifice and a conduit to channel the product emerging from the dispensing element to the dispensing orifice, wherein said conduit includes an end portion, said end portion including a front and a rear, and wherein said dispensing orifice is provided at the front of said end portion such that said dispensing orifice opens toward a first direction, and further wherein at least one bearing surface is provided on the rear of said end portion such that said bearing surface faces toward a second direction opposite said first direction and wherein the second direction is a direction toward the dispensing element;

an actuating surface, which is movable relative to the mounting element, to actuate the dispensing element, wherein the actuating surface and the conduit are molded as a single piece;

a closure element configured to cover the dispensing orifice in a stowed position, wherein the closure element is moved to the stowed position by a force, wherein the force is exerted on the closure element and on the dispensing head, axially to the conduit, in the second direction toward the dispensing element; and a stop which limits movement of the dispensing head in said second direction as the closure element is moved to the stowed position, and wherein the stop includes a portion facing the bearing surface, with said portion facing toward said first direction, and wherein said stop is arranged so that the bearing surface on the rear of said end portion of the conduit bears against said portion of the stop when the closure element is moved to the stowed position.

2. A device according to claim 1, wherein the stop is immobile when the actuating surface is operated.

3. A device according to claim 1, wherein the stop includes a notch configured to straddle the conduit.

4. A device according to claim 1, wherein the stop includes two vertical walls integral with the mounting element, the vertical walls being respectively located on opposite sides of the conduit.

5. A device according to claim 1, wherein the closure element is configured to seal off the dispensing orifice.

6. A device according to claim 1, wherein the closure element is configured so that, in the stowed position, it limits the movement of the actuating surface thereby preventing actuation of the dispensing element.

7. A device according to claim 1, wherein the closure element includes a flap pivoted about a flap pivot axis.

8. A device according to claim 7, wherein the flap pivot axis is substantially perpendicular to a principal axis of the conduit.

9. A device according to claim 7, wherein the flap is pivotably mounted by a film hinge.

10. A device according to claim 7, wherein the flap includes a wall intended to be placed against the dispensing orifice, wherein the wall includes a projecting element at least part of which fits under an end of the conduit of the dispensing head in the stowed position.

11. A device according to claim 10, wherein the end of the conduit is cylindrical and the projecting element is a cylindrical skirt designed to surround the end of the conduit of the dispensing head.

12. A device according to claim 11, wherein the outer surface of the end of the conduit includes an annular groove which, in the stowed position, receives an annular bead provided on an inner surface of the skirt.

13. A device according to claim 1, wherein the mounting element includes a frontal opening in a region of the dispensing orifice.

14. A device according to claim 1, wherein the closure element includes a mounting bracket for attachment to the mounting element.

15. A device according to claim 14, wherein the bracket includes two vertical ribs designed to fit in two slides provided on the mounting element.

16. A device according to claim 15, wherein the slides are respectively located on two sides of a frontal opening located in a region of the dispensing orifice.

17. A device according to claim 1, wherein the mounting element, the actuating surface and the dispensing head are molded as one piece.

18. A device according to claim 1, wherein the stop is molded as one piece with the mounting element, the actuating surface and the dispensing head.

19. A device according to claim 1, wherein the closure element is molded as one piece with the mounting element, the actuating surface and the dispensing head.

20. A device according to claim 1, wherein a nozzle is associated with the dispensing orifice.

21. A device according to claim 20, wherein the nozzle is a swirl nozzle.

22. A device according to claim 21, wherein the nozzle is fitted at the front of said end portion of the conduit, and wherein the conduit has a circular transverse cross-section.

23. A device according to claim 1, in combination with a container holding a product to be dispensed, and wherein the container is fitted with the dispensing device to form a packaging and dispensing device.

24. A device according to claim 23, wherein the container is pressurized.

25. A device according to claim 23, wherein the container is surmounted by a valve stem.

26. A device according to claim 23, wherein the product held in the container is a cosmetic product.

27. A device according to claim 26, wherein the product is a hair product.

28. A device according to claim 27, wherein the hair product is a lacquer.

29. A device according to claim 1, wherein said rear of said end portion of the conduit includes an enlarged cross-section that forms said at least one bearing surface which bears against said stop as said closure element is moved to the stowed position.

30. A device according to claim 29, wherein the closure element includes a projecting portion which extends around at least a portion of a periphery of the dispensing orifice, wherein said projecting portion limits movement of the dispensing orifice and thereby limits movement of the actuating surface when the closure element is in the stowed position.

31. A device according to claim 1, wherein the closure element includes a projecting portion which extends around at least a portion of a periphery of the dispensing orifice, wherein said projecting portion limits movement of the dispensing orifice and thereby limits movement of the actuating surface when the closure is in the stowed position.

32. A dispensing device comprising:

a mounting portion at which the device can be mounted to a container; a dispensing head which includes a conduit to channel product from a container, the conduit including an end portion, wherein the end portion includes a front from which product exits the dispensing head after passing through the channel, and wherein the end portion includes a dispensing orifice on said front such that said dispensing orifice opens toward a first direction, and wherein said end portion further includes a rear with at least one bearing surface provided on said rear of said end portion such that said bearing surface faces toward a second direction opposite said first direction;

an actuating surface which is movable to actuate a dispensing element associated with the container, wherein the actuating surface is coupled to the dispensing head such that movement of the actuating surface causes movement of the end portion of the dispensing head;

a closure element which is movable between a dispensing position and a stowed position, wherein in said stowed position said closure element covers at least part of the end portion of the conduit, and wherein in the stowed position said closure element limits movement of said end portion and thereby limits movement of said actuation surface, wherein as the closure element is moved to the stowed position a force is exerted upon said end portion in the second direction toward the dispensing head; and a stop member, said stop member including a stopping surface facing the bearing surface with said stopping surface facing toward said first direction and wherein said bearing surface of said rear of said end portion contacts said stopping surface to limit movement of said end portion in said second direction as said closure element is moved to the stowed position.

33. A device according to claim 32, wherein said end portion has an enlarged cross-section relative to an adjacent portion of said conduit and wherein said bearing surface is provided by the enlarged cross-section such that said bearing surface bears against said stop member as said closure element is moved to said stowed position.

34. A device according to claim 32, wherein said closure element includes a projecting portion which extends around at least part of a periphery of said end portion of said conduit.

35. A device according to claim 34, further including a bead and a groove which couple the projecting portion and the end portion together in the stowed position.

36. A device according to claim 34, wherein the projecting portion encircles the periphery of the end portion.

37. A dispensing device according to claim 1, wherein said end portion moves in a transverse direction in response to actuation of said actuating surface, wherein said transverse direction is transverse to said second direction toward the dispensing element, wherein said second direction toward the dispensing element is in an axial direction of the conduit, and wherein when said closure element is in said stowed position said closure element prevents movement of said end portion in said transverse direction, and further wherein said stop limits movement of the end portion in said axial direction when the closure element is open and when the closure element is moved to the stowed position as said bearing surface of the rear of said end portion contacts said stop.

38. A dispensing device according to claim 32, wherein said end portion moves in a transverse direction in response to actuation of said actuating surface, wherein said transverse direction is transverse to said second direction toward the dispensing head, wherein said second direction toward the dispensing head is in an axial direction of said conduit, and wherein when said closure element is in said stowed position said closure element prevents movement of said end portion in said transverse direction, and further wherein said stop member limits movement of the end portion in said axial direction when the closure element is open and when the closure element is moved to the stowed position as said bearing surface of the rear of said end portion contacts said stop member.

* * * * *